United States Patent [19]

McLean

[11] 4,325,519

[45] Apr. 20, 1982

[54] SHEET MATERIAL DISPENSING MECHANISM

[75] Inventor: John R. McLean, Richmond, Va.

[73] Assignee: Reynolds Metals Company, Richmond, Va.

[21] Appl. No.: 192,009

[22] Filed: Sep. 29, 1980

[51] Int. Cl.[3] ..... B65H 23/08

[52] U.S. Cl. ..... 242/75.41

[58] Field of Search ..... 242/75.41, 75.42, 75.43, 242/75.44, 56.8; 226/104, 56; 254/392

[56] References Cited

U.S. PATENT DOCUMENTS

| | | | |
|---|---|---|---|
| 432,233 | 7/1890 | Fowler | 242/75.41 |
| 2,567,049 | 9/1951 | Belluche | 242/75.2 X |
| 3,117,048 | 1/1964 | Rechel | 242/75.41 X |
| 3,146,283 | 8/1964 | Valle | 242/56.8 X |
| 3,446,452 | 5/1969 | Tetens | 242/75.43 |
| 3,463,413 | 8/1969 | Smith | 242/75.43 |
| 3,550,827 | 12/1970 | Timble | 226/25 |
| 3,974,948 | 8/1976 | Kroppenstedt | 242/75.42 |
| 3,976,261 | 8/1976 | Long | 242/75.41 |

*Primary Examiner*—Edward J. McCarthy

*Attorney, Agent, or Firm*—Lyne, Girard and McDonald

[57] ABSTRACT

An apparatus is disclosed for intermittently dispensing sheet material from a roll to an operating apparatus. The apparatus includes means for accumulating sheet material from the roll which does not require the roll to be motor driven and means for preventing pull back of the sheet material through the dispensing apparatus and permitting low force advancement of the sheet material.

4 Claims, 3 Drawing Figures

SHEET MATERIAL DISPENSING MECHANISM

BACKGROUND OF THE INVENTION

Numerous apparatus requires the dispensing of sheet material from a roll to the apparatus. In many instances, notably wrapping machines, such as plastic film wrappers and the like, the wrapping sheet material is dispensed intermittently to the wrapping apparatus as a package advances therethrough, with no sheet material being dispensed to the apparatus during the sealing of the package and during the reverse stroke of the apparatus.

Rolls of sheet material, such as plastic film, paper, aluminum foil and the like, are quite heavy. Thus, the removal of sheet material from these rolls begins the rotation of a large mass, with the roll tending to maintain its rotation by its own momentum, leading to a loss of tension in the dispensing apparatus. For this reason, many intermittent sheet dispensing mechanisms do not permit the roll of sheet material to be dispensed under low tensions. Alternatively, the rolls of sheet material are mounted on a motor driven support, such that the roll can be rotated when positively driven. While motor driven sheet dispensing mechanisms permit low tension feeding, these motor driven unwinders are expensive and require electrical and mechanical maintenance.

It is thus a primary object of the present invention to provide an apparatus for dispensing sheet material from a roll in which low tension control of the sheet material can be maintained while intermittently dispensing sheet material without the necessity of a motor driven unwind.

Another problem common to apparatus employing intermittent sheet material dispensing, and notably wrapping machines, is that the end of the sheet material which is cut from the package as it is sealed is free, i.e., is not held in place by any means. Thus, when any tension is maintained in the dispensing apparatus for the sheet material to be dispensed to the apparatus using this sheet material, pull back of the free end of the sheet material into the dispensing apparatus can be a problem.

It is thus another primary object of the present invention to provide a sheet material dispensing apparatus which eliminates pull back of the free end of sheet material.

Still another problem when dispensing from rolls of sheet material is the reduction of inertia as the mass of the roll decreases, thus causing changes in tension in the sheet material within the dispensing apparatus.

It is thus another object of the present invention to eliminate the effect in inertial force changes of the roll.

THE PRESENT INVENTION

By means of the present invention, these objects are obtained. The sheet dispensing apparatus of the present invention comprises a plurality of rollers, with alternate rollers being pivotally mounted, to provide a festooned sheet material accumulation region and to control tension in the film and a direction limiting mechanism in contact with the sheet material as it leaves the dispensing apparatus to permit the sheet material to freely exit the dispensing apparatus, but to prevent sheet material from pulling back into the dispensing apparatus when under a tension lower than that maintained within the dispensing apparatus.

When employing the present apparatus, sheet material, such as plastic film and the like, may be readily intermittently dispensed at a minimum tension from a roll of the sheet material without the necessity of a motor driven roll.

BRIEF DESCRIPTION OF THE DRAWINGS

The sheet material dispensing mechanism of the present invention will be more fully described with reference to the drawings in which.

DETAILED DESCRIPTION OF THE PREFERRED EMBODIMENT

Figure 1:
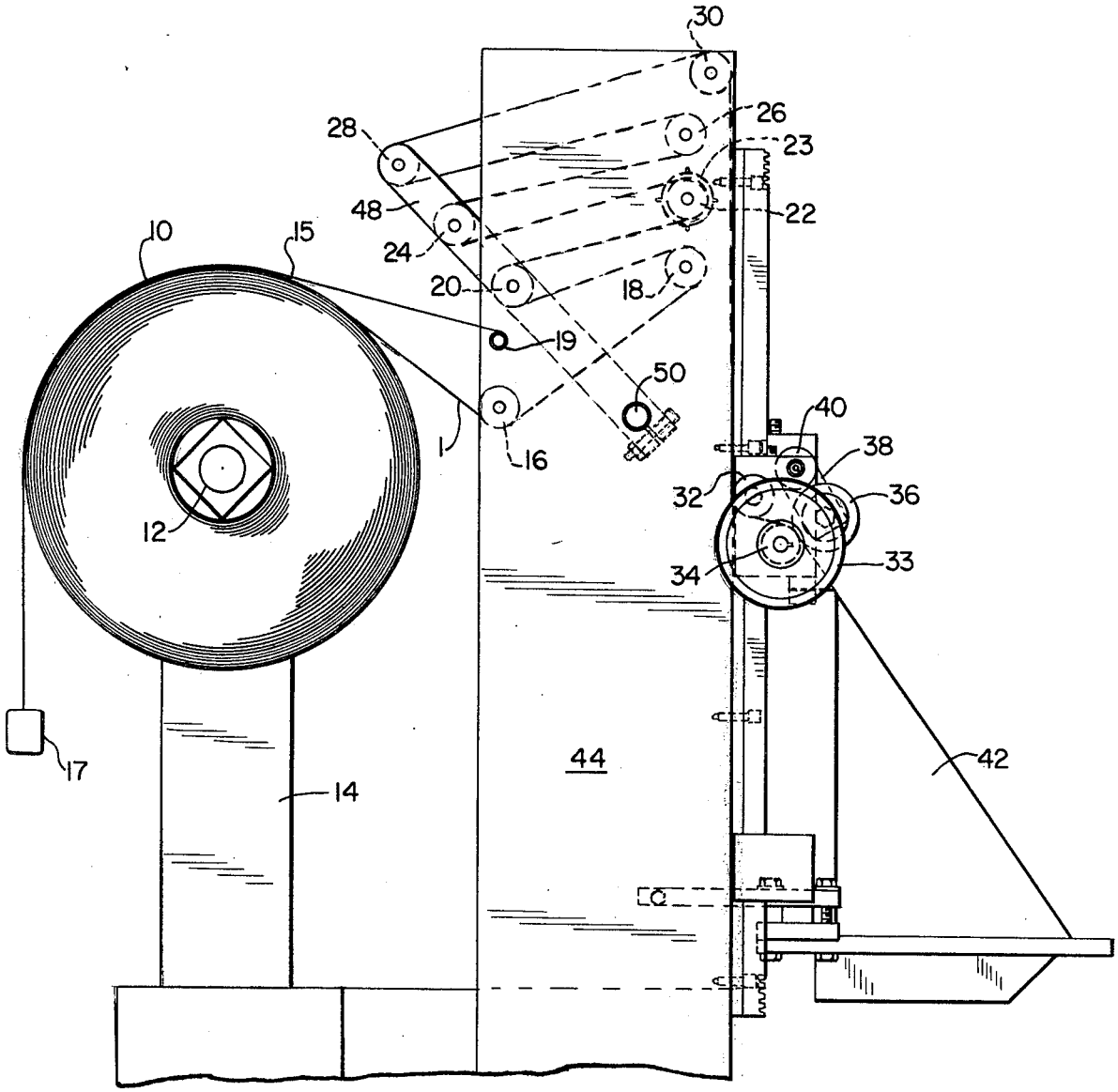
FIG. 1 is a left side elevational view illustrating the sheet dispensing apparatus of the present invention.
Figure 2:
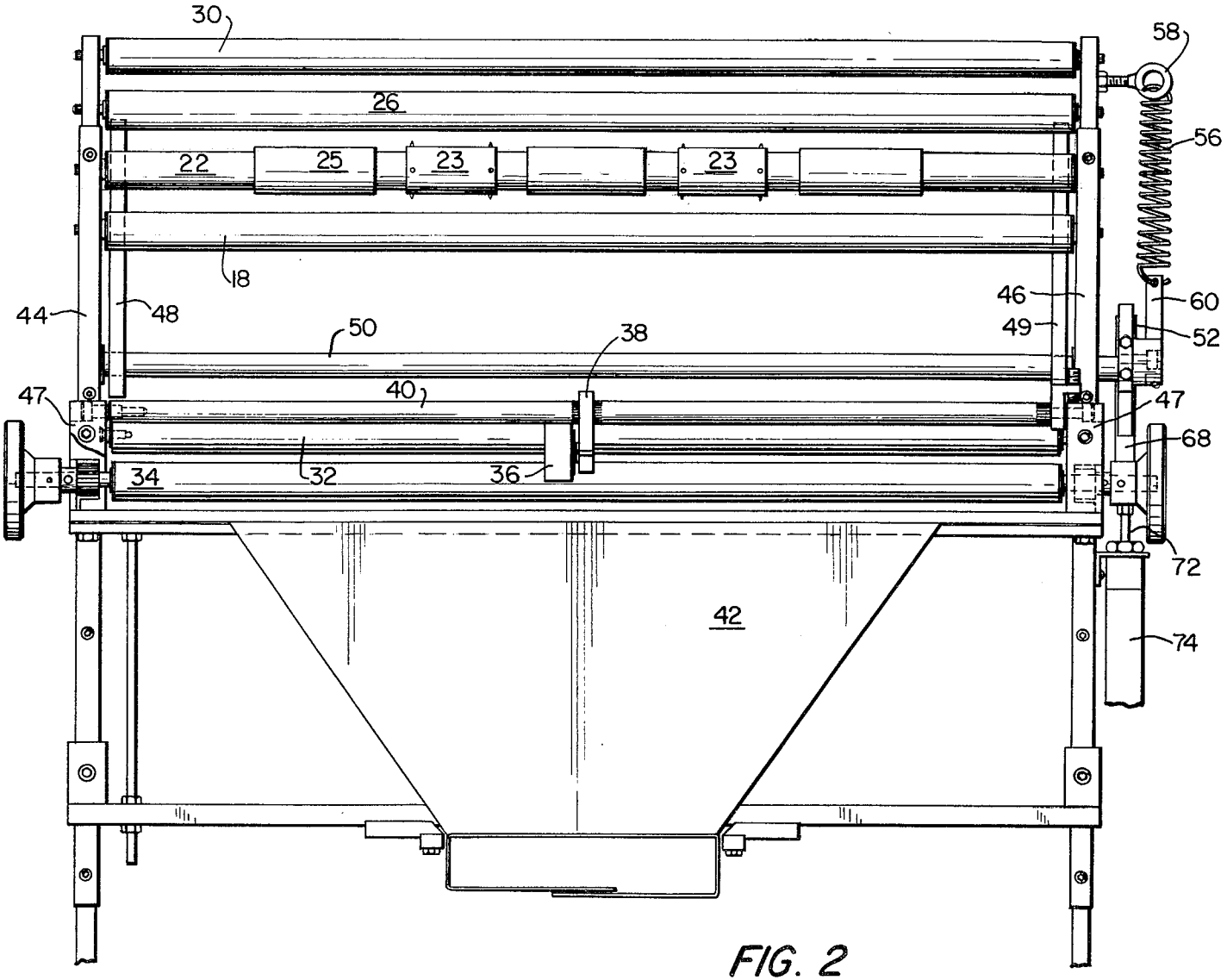
FIG. 2 is a front elevational view of the sheet dispensing apparatus.
Figure 3:
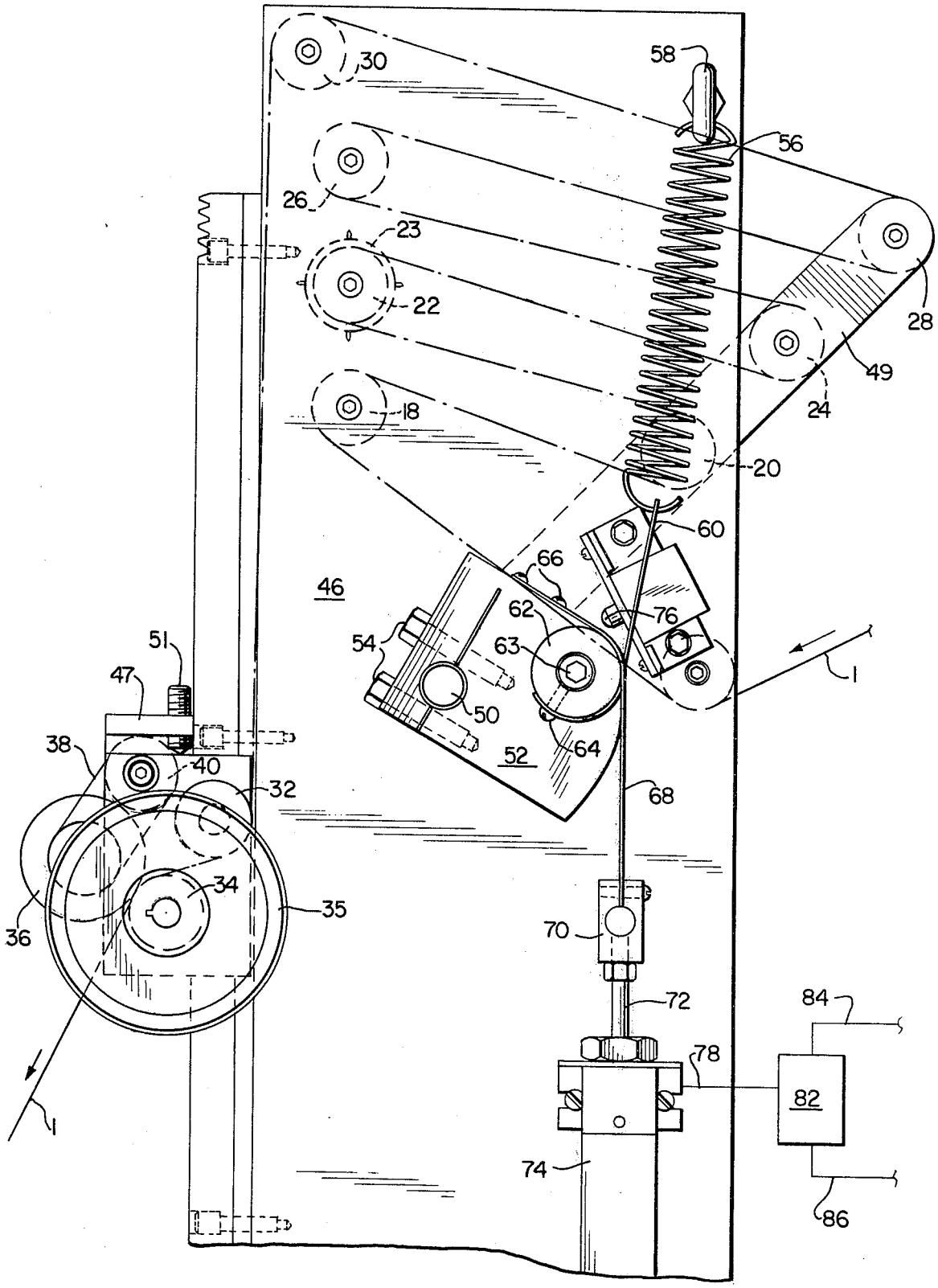
FIG. 3 is an expanded right side elevational view illustrating the tension control mechanism employed in the present invention.

Turning now to the FIGURES, the sheet material dispensing apparatus of the present invention is illustrated. A roll 10 of sheet material 1 is mounted upon a bearing supported reel 12 carried upon a stand 14. The roll 10 is mounted upon reel 12 to be free-wheeling. Thus, the sole driving force for the roll 10 is a pulling force on the roll 10 created by the sheet material 1.

To prevent overcoast of the roll 10 and slack in the sheet material 1, a brake mechanism is provided against the exterior surface of roll 10. As illustrated, a drag brake, comprising a belt 15 connected to shaft 19 and a weight 17 provide the braking action. The weight 17 is selected to prevent overcoast of the largest mass which could be present in roll 10. Other brake mechanisms, such as a braked roller contacting roll 10, may be substituted for the illustrated drag brake.

The sheet material 1 may be any sheet material in roll form, as determined by the ultimate purpose to which the material is to be employed and the apparatus which is fed by the sheet dispensing mechanism of the present invention. Thus, such sheet materials as plastic film, paper, aluminum foil, paper-foil laminates and the like may be fed by the sheet dispensing mechanism of the present invention. As illustrated, the sheet feeding mechanism of the present invention is shown dispensing plastic film to a plastic film wrapping apparatus and thus further references to "film 1" should be understood to mean film or other sheet materials.

As the film 1 leaves reel 10, it passes around a free-wheeling entry roller 16 and is then festooned around a plurality of free-wheeling accumulator rolls 18, 20, 22, 24, 26, 28 and 30. These accumulator rolls provide an accumulated supply of film 1 at least sufficient to accomplish an intermittent operation by the apparatus to which the dispensing system of the present invention is linked. Thus, as illustrated, a sufficient quantity of film 1 is provided between these rolls to accomplish the wrapping of a package.

Accumulating rolls 18, 22, 26 and 30 are mounted between frame members 44 and 46 for free-wheeling rotation. As shown, roll 22 includes punching collars 23 and guide collars 25 thereon. The collars 23 are perforating collars for punching holes in plastic film 1 when employing a shrink film for packaging purposes and the collars 25 are employed to produce a relatively even surface with collars 23. If shrink plastic film were not employed as the sheet material being fed by the mechanism, collars 23 and 25 could be eliminated.

Accumulating rolls 20, 24 and 28 are pivotally carried for free-wheeling rotation between pivoting bar members 48 and 49. These pivotable bar members are mounted upon rod 50, which rod 50 is pivotally mounted between frame members 44 and 46. The pivoting action of these elements will be described below.

After the film 1 passes around accumulating roll 30, it next passes around exit guide roll 32 and between exit roll 34 and rotation direction limiting clutch 36. Once again, rolls 32 and 34 are free-wheeling rolls. However, clutch 36 is not free-wheeling. Clutch 36 is a one-way roller, permitting the film 1 to pass between it and roll 34 in an exit direction. However, should the film 1 attempt to pull back due to tension between the accumulator rolls while the end of the film 1 is free, the one-way clutch 36, due to its interior bearing mechanism, which mechanism is known in the art, prohibits the film 1 from reversing its direction of motion.

Clutch 36 is mounted by means of a bracket 38 to support bar 40. Support bar 40 is suspended between frame members 44 and 46 by means of vertically adjustable brackets 47, which brackets 47 include a threaded spring plunger 51 to control the pressure between clutch 36 and roll 34.

As previously mentioned, accumulator rolls 20, 24, and 28 are mounted for free-wheeling rotation between pivotable bars 48 and 49. These pivotable bars 48 and 49 pivot with the rotation of bar 50 upon which they are mounted. At one end of bar 50 is a cam block 52. Cam block 52 is attached to the end of bar 50, such as by mounting fasteners 54. Rod 50 is rotated, and thus pivotable bars 48 and 49 are pivoted, by movements of this cam block 52. Connected to the cam block 52 is a spring member 56. This spring member 56 is mounted onto frame 46 by means of eyelet 58 and to cam block 52 by means of band 60. Band 60 passes around a connecting disk 62, which connecting disk 62 is mounted upon cam block 52. Band 60 is connected to the connecting disk 62 by means of bolt 64. To permit adjustments in the tension of spring 56, for reasons that will be described below, connecting disc 62 is rotated by loosening fastener 63.

Also attached to cam block 52, by means of fasteners 66, is band 68. Band 68 is connected at its other end by means of connecting block 70 to a piston rod 72 of an air cylinder 74.

As illustrated, the sheet dispensing apparatus is ready to dispense a length of sheet material. The apparatus which is to receive the film 1, such as the forming collar 42 of a film wrapping machine as illustrated, pulls on the free end of the film 1. This causes the film 1 festooned between accumulator rolls 18, 20, 22, 24, 26, 28 and 30 to advance, and the pivotable bars 48 and 49 and mounting block 52 to pivot toward fixed rollers 18, 22, 26 and 30. During this operation, an extremely low tension of between about 0.5 to 10 pounds (0.23 to 4.54 kilograms), and preferably between about 0.5 to 1.0 pound (0.23 to 0.450 kilograms), is maintained in the film 1. This tension is provided by low pressure, i.e. between about 3 to 10 pounds per square inch (2109.3 to 7031.0 kilograms per square meter), air pressure from line 84 through valve 82 and to line 78 pulling piston rod 72 downwardly, tending to rotate cam block 52 and thus pivoting members 48 and 49 away from the fixed rolls 18, 22, 26 and 30, and spring 56 at the same time attempting to pull cam block 54 upwardly, with its tension adjusted by positioning of disc 62, thus tending to pivot bar members 48 and 49 toward the fixed rolls 18, 22, 26 and 30. The slight tension between these two forces is overcome by the pulling action at the free end of the film 1, permitting the film 1 to play out and dispense the sheet material 1.

As cam block 52 is pivoted upwardly, it eventually contacts switch member 76. This signal to switch member 76 acts upon air supply valve 82, switching from low pressure air through line 84 to line 78 and to the air cylinder 74 to high pressure air at a pressure of between about 30 to 60 pounds per square inch (21093 to 42186 kilograms per square meter) through line 86 and to the air cylinder 74 through line 78. The action caused by switch 76 is restricted during the play out of film 1 by a second switch means (not shown) associated with the apparatus receiving the film 1, such that high pressure air is not supplied while film 1 is being played out. The action of the high air pressure increases the downward force through band 68, pulling cam block 52 downwardly, and pivoting bars 48 and 49 away from the fixed rolls 18, 22, 24 and 26. Since the film end 1 cannot move backwardly, due to clutch 36, the film necessary to replenish the accumulator rolls is played out off of reel 10.

When cam block 54 comes out of contact with switch 76, valve 82 once again returns to low pressure air through line 78. At this point, the downward force through band 68 is sufficient only to maintain tension in the sheet material 1 until the momentum of roll 10 ceases.

Adjustments may be made to assure proper starting position of pivotable bars 48 and 49 by rotation of the cam block 52 with respect to rod 50. This will either increase or decrease the amount of time that cam block 52 is in contact with switch 76.

From the foregoing, it is clear that the present invention provides an apparatus for intermittently dispensing sheet material from a roll without the necessity of a motor drive and while maintaining proper low tension in the sheet material and preventing pull back of the free end of the film between intermittent dispensings.

While a presently preferred embodiment of the present invention has been illustrated and described, it is clear that the invention may be otherwise variously embodied and practiced, within the scope of the following claims.

I claim:

1. An apparatus for dispensing sheet material from a roll comprising a reel upon which said roll is mounted, brake means for preventing overcoast of said roll during dispensing therefrom, a plurality of free-wheeling, fixedly mounted rollers, a plurality of free-wheeling, pivotally mounted rollers, said fixedly mounted rollers and said pivotally mounted rollers forming a sheet material accumulator, a mounting for said pivotally mounted rollers comprising a pair of bars between which said pivotally mounted rollers are mounted and a rotatable rod upon which said bars are mounted, an air cylinder connected to said mounting for said pivotally mounted rollers for pivoting said pivotally mounted rollers to accumulate sheet material in said accumulator, a spring connected to said mounting for said pivotally mounted rollers and acting to oppose the action of said air cylinder to maintain low tension in said sheet material during holding thereof in said accumulator and means for preventing pull back of said sheet material into said apparatus after dispensing therefrom.

2. The apparatus of claim 1 wherein said brake means comprises a weighted belt in contact with the outer surface of said roll.

3. The apparatus of claim 1 wherein said means for preventing pull back comprises a one-way clutch and an exit roller between which said sheet material exits said apparatus.

4. The apparatus of claim 1 wherein one of said accumulator rollers includes a punching collar to produce holes in said sheet material.

* * * * *